US005715887A

United States Patent [19]

Hosokawa

[11] Patent Number: 5,715,887

[45] Date of Patent: Feb. 10, 1998

[54] METAL WOOD GOLF HEAD AND METAL WOOD GOLF CLUB WITH THIS CLUB HEAD; AND METHOD FOR PRODUCING THE CLUB HEAD AND THE GOLF CLUB

[76] Inventor: Toshihiro Hosokawa, 2820, Ikedashimomachi, Izumi City, Osaka, Japan

[21] Appl. No.: 548,911

[22] Filed: Oct. 26, 1995

[30] Foreign Application Priority Data

Sep. 26, 1995 [JP] Japan ..... 7-273498

[51] Int. Cl.[6] ..... B22D 19/00; B22D 27/09

[52] U.S. Cl. ..... 164/97; 164/98; 164/113

[58] Field of Search ..... 164/97, 98, 361, 164/113

[56] References Cited

U.S. PATENT DOCUMENTS 5,078,397 1/1992 Aizawa ..... 273/78
5,301,941 4/1994 Allen ..... 164/98

*Primary Examiner*—Joseph J. Hail, III
*Assistant Examiner*—I.-H. Lin
*Attorney, Agent, or Firm*—Curtis L. Harrington

[57] ABSTRACT

The present invention relates to a metal wood golf club head comprising a metal outer husk with a hollow inside portion and foaming metal or foaming carbon material compounded with carbon fibers arranged in the hollow inside portion and a metal wood golf club with this club head, and a method for producing the club head and the golf club by casting with said foaming metal or said foaming carbon material compounded with carbon fibers as a core which is rough-cut by machine to leave the portion to be kept in cutting and then is formed by a mold and covered with metal sheet.

5 Claims, 4 Drawing Sheets

METAL WOOD GOLF HEAD AND METAL WOOD GOLF CLUB WITH THIS CLUB HEAD; AND METHOD FOR PRODUCING THE CLUB HEAD AND THE GOLF CLUB

FIELD OF THE INVENTION

This invention relates to a metal wood club head for golf and a metal wood golf club with this club head and a method for producing foaming metal or foaming carbon material compounded with carbon fibers used for the club head. The objects of the invention are to produce readily a metal wood golf club head of high quality and a metal wood golf club with this club head, to provide a metal wood golf club head and a metal wood golf club with this club head which are suitable for mass production, and to provide a method for producing the club head and the golf club.

PRIOR ART

The present inventor has already proposed a metal wood club head comprising a metal outer shell with a hollow inside portion and foaming metal arranged in the hollow inside portion which has superior qualities such as the club head, through a shaft, can transmit the feeling of a shot similar to persimmon club heads to the user's hands, and causes little trouble to the user's elbows because of the soft feel at impact. (Japanese Patent Application No. hei 7-124469).

However, there are some problems for mass production of the above metal wood club head described below.

In producing of the foaming metal arranged in the hollow inside portion of the metal outer shell, it is difficult to process the foaming metal only by cutting since chucking is difficult due to the configuration into which the foaming metal is to be formed and the quality of the material. Moreover, the foaming metal may be melted by heat of molten metal when the foaming metal is infolded in metal by casting.

The present inventor has thought of use of foaming carbon material compounded with carbon fibers with superior heat-resistance instead of foaming metal, however, it can not completely solve the above problems. Therefore the present invention has the objects to produce readily a metal wood golf club head of high quality and a metal wood golf club with this club head, to provide a metal wood golf club head and a metal wood golf club with this club head which are suitable for mass-production, and to provide a method for producing the club head and the golf club.

SUMMARY OF THE INVENTION

This invention is to solve the above mentioned problems.

The present invention relates to a metal wood club head comprising a metal outer shell with a hollow inside portion and foaming metal or roaming carbon material compounded with carbon fibers arranged in the hollow inside portion which is casted with a spacer laid between the foaming metal or the foaming carbon material compounded with carbon fibers as a core and a casting mold. Therefore a metal wood club having foaming metal or foaming carbon material compounded with carbon fibers arranged in hollow inside portion thereof can be readily produced since it is possible to position and fix a core of foaming metal or foaming carbon material compounded with carbon fibers as it is floating in the air in a casting mold.

The present invention relates to a metal wood club head, wherein said spacer is chaplets. Therefore a metal wood club head having foaming metal or foaming carbon material compounded with carbon fibers arranged in hollow inside portion thereof can be readily produced since it is possible to position and fix a core of foaming metal or foaming carbon material compounded with carbon fibers by the chaplets as it is floating in the air in a casting mold by the chaplet.

The present invention relates to a metal wood club head, wherein said core of foaming metal or foaming carbon material compounded with carbon fibers is covered with metal sheet. Therefore the foaming metal or the foaming carbon material compounded with carbon fibers is not melted by heat of molten metal since the metal sheet covering the foaming metal or the foaming carbon material compounded with carbon fibers and air layer prevent heat of molten metal in casting.

The present invention relates to a metal wood club head, wherein said metal sheet has apertures through which a part of molten metal is poured to cast said core and said outer shell integrally. Therefore the foaming metal or the foaming carbon material compounded with carbon fibers can adhere more closely to the metal sheet since a part of molten metal enters from the apertures and melts into the foaming metal or the foaming carbon material compounded with carbon fibers.

The present invention relates to a metal wood club head, wherein raised portions are provided by cutting and raising said metal sheet to position and fix said core in a casting mold and the core and said metal outer shell are casted integrally by pouring a part of molten metal through the base apertures of the raised portions. Therefore the foaming metal or the foaming carbon material compounded with carbon fibers can adhere more closely to the metal sheet since a part of molten metal enters from the base apertures and melts into the foaming metal or the foaming carbon material compounded with carbon fibers. Moreover the core can be positioned and fixed in a casting mold without chaplets.

The present invention of claim 11 relates to a method for producing a metal wood club head comprising a metal outer shell with a hollow inside portion and foaming metal or foaming carbon material compounded with carbon fibers arranged in the hollow inside portion and a metal wood golf club with this club head, wherein said foaming metal or said foaming carbon material compounded with carbon fibers is rough-cut by machine to leave the portion to be kept in cutting and then is formed by a forming mold. Therefore, by forming by a mold after rough cutting by machine, the present invention can solve the problem in producing of foaming metal or foaming carbon material compounded with carbon fibers that it is difficult to process foaming metal or foaming carbon material compounded with carbon fibers only by cutting since chucking is difficult due to the configuration into which the foaming metal or the foaming carbon material compounded with carbon fibers is to be formed and the quality of the material. The invention also solve the problem occuring in forming only by press that the surface of foaming metal or foaming carbon material compounded with carbon fibers is broken so that high absorptivity at impact and good feeling of a shot cannot be obtained at the finish.

The present invention relates to a method for producing a metal wood club head and a metal wood golf club with this club head, wherein said foaming metal or foaming carbon material compounded with carbon fibers as a core is casted with a spacer laid between the core and a casting mold. Therefore a metal wood club head having foaming metal or foaming carbon material compounded with carbon fibers arranged in hollow inside portion thereof can be readily produced since it is possible to position and fix a core of foaming metal or foaming carbon material compounded with carbon fibers as it is floating in the air in a casting mold.

The present invention relates to a method for producing a metal wood club head and a metal wood golf club with this club head, wherein said core of foaming metal or foaming carbon material compounded with carbon fibers is covered with metal sheet. Therefore the foaming metal or the foaming carbon material compounded with carbon fibers is not melt by heat of molten metal since the metal sheet covering the foaming metal or the foaming carbon material compounded with carbon fibers and air layer prevent heat of molten metal in casting.

The present invention relates to a method for producing a metal wood club head and a metal wood golf club with this club head, wherein said metal sheet has apertures through which a part of molten metal is poured to cast said core and said metal outer shell integrally. Therefore the foaming metal or the foaming carbon material compounded with carbon fibers can adhere more closely to the metal sheet since a part of molten metal enters from the apertures and melts into the foaming metal or the foaming carbon material compounded with carbon fibers.

The present invention relates to a method for producing a metal wood club head and a metal wood golf club with this club head, wherein raised portions are provided by cutting and raising said metal sheet to position and fix said core in a casting mold and the core and said metal outer shell are casted integrally by pouring a part of molten metal through the base apertures of the raised portions. Therefore the foaming metal or the foaming carbon material compounded with carbon fibers can adhere more closely to the metal sheet since a part of molten metal enters from the base apertures and melts into the foaming metal or the foaming carbon material compounded with carbon fibers. Moreover the core can be positioned and fixed in a casting mold without chaplets.

DETAILED DESCRIPTION OF THE INVENTION

Figure 1:
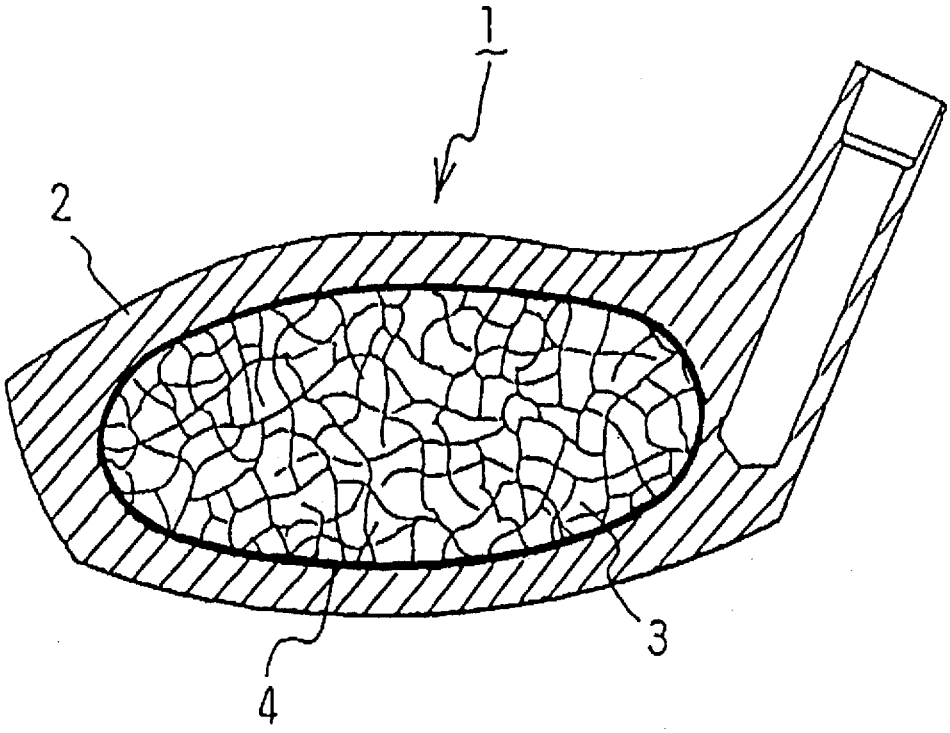
FIG. 1 is a model sectional view showing an embodiment of a finished metal wood club head for golf relating to the present invention.

Referring to the drawings, a metal wood club head for golf and a metal wood golf club with this club head, and a method for producing the club head and the golf club relating to the present invention will be described hereinafter.

FIG. 1 is a model sectional view showing an embodiment of a finished metal wood club head for golf relating to the present invention.

Metal wood club head 1 comprises metal outer shell 2 having a hollow inside portion, foaming metal 3 arranged in the hollow inside portion and metal sheet 4 lying between foaming metal 3 and metal outer shell 2.

Said foaming metal 3 means light metal composite with superb lightness and absorptivity at impact which is porous and has independent or sequential foams dispersed as cells. The kind of foaming metal 3 is not limited but foaming aluminium is favorably used because of its small specific gravity and its superb absorptivity at impact.

In this invention, foaming carbon material compounded with carbon fibers may be used in place of foaming metal 3. As for the carbon material, carbon material containing carbon fibers in the range of 20–80% may be favorably used, and carbon matarial containing carbon fibers in the range of 40–60% is most favorably used. Specific gravity of carbon material compounded with carbon fibers is 1.7 and heat-resistant temperature is 2,000° C.

A method for producing metal wood club head 1 and a golf club with this club head will be described hereinafter.

Figure 2:
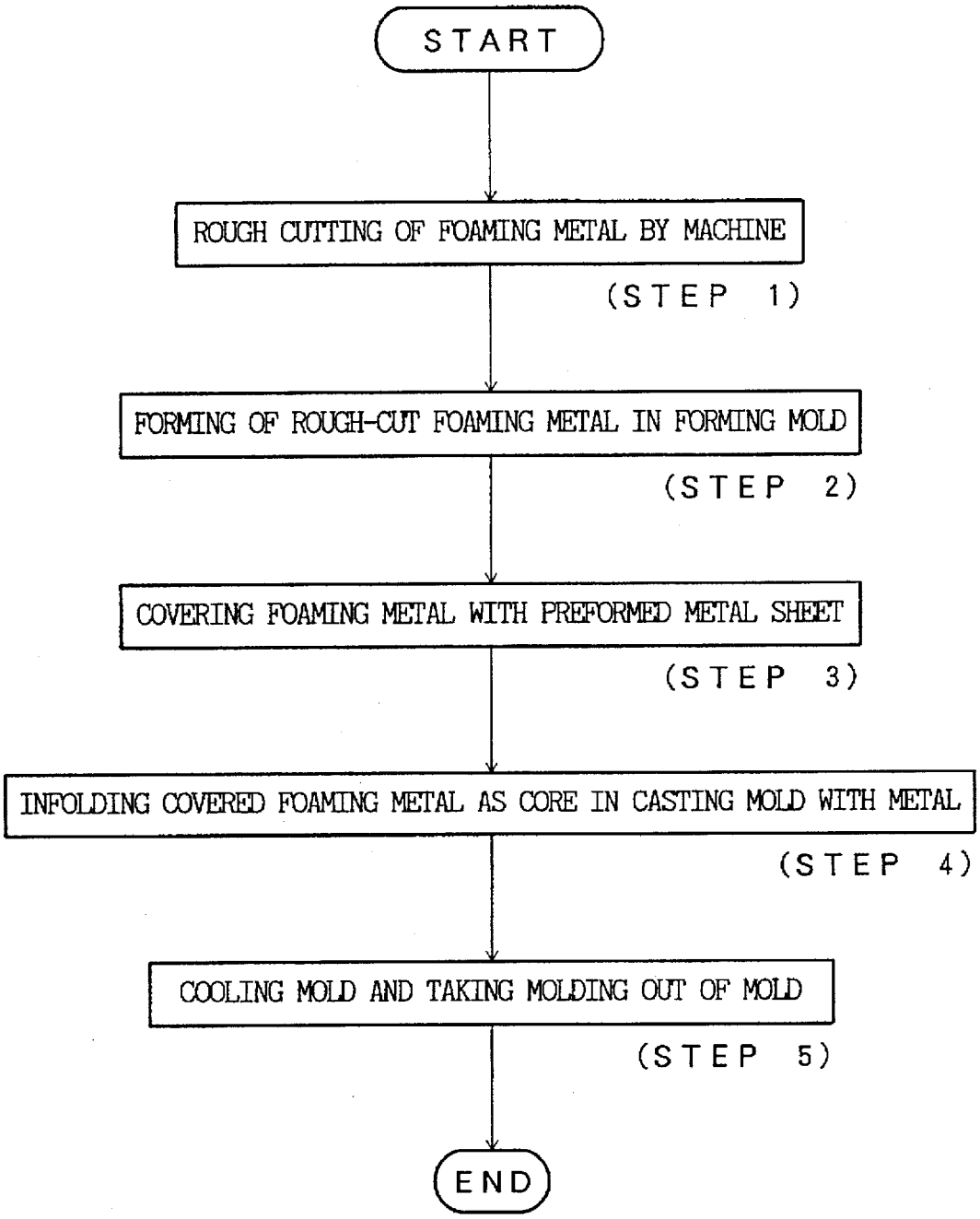
FIG. 2 is a flow chart showing steps of producing a metal wood club head for golf relating to the present invention.

FIG. 2 is a flow chart showing an embodiment of steps for producing metal wood club head 1 relating to the present invention.

In the below described embodiment, foaming metal 3 is arranged in a hollow inside portion of metal wood club head 1, however, foaming carbon material compounded with carbon fibers maybe substituted for foaming metal 3.

According to the flow chart, the present invention will be described hereinafter.

In step 1, a lump of foaming metal 3 is rough-cut by machine to leave the portion to be kept in cutting.

Concrete methods of the rough-cutting are not particularly limited and any machine tools suitable for forming foaming metal into a required configuration may be adopted, for example, lathe or milling cutter.

Figure 3:
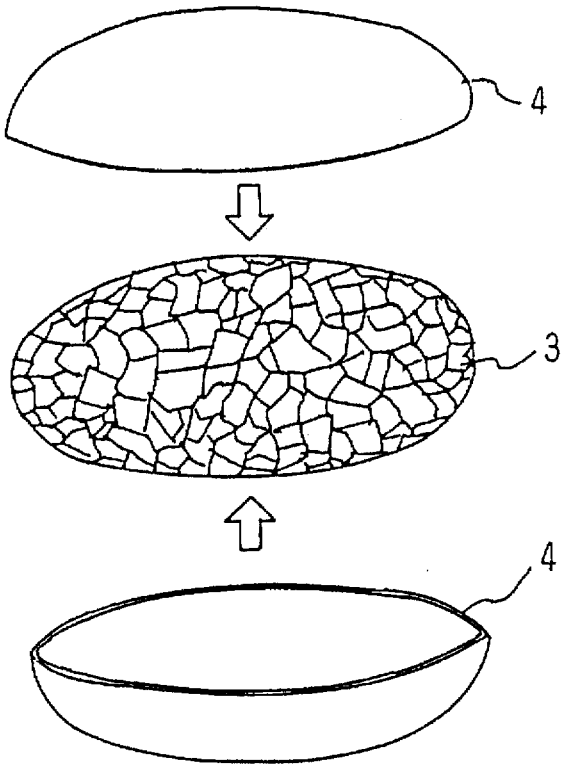
FIG. 3 is a model view of step 3 of producing a metal wood club head for golf relating to the present inveniton.

In step 2, rough-cut foaming metal 3 is formed into an egg-shape as shown in FIG. 3 in a mold comprising an upper mold and a lower mold.

The forming is generally referred to as die forging whereby foaming metal 3 formed into a required configuration by clamping rough-cut foaming metal 3 put into a mold of the required configration.

There is the problem in producing of foaming metal 3 that it is difficult to process foaming metal only by cutting because chucking is difficult due to the configuration into which foaming metal is to be formed and the quality of the material. The problem can be solved by forming foaming metal 3 by a mold after rough cutting by machine as shown in the above mentioned steps 1 and 2.

To form foaming metal 3 by a mold after rough cutting by machine can also solve the problem occuring in forming only by press that the surface of foaming metal is broken so that high absorptivity at impact and good feeling of a shot can not be obtained at the finish.

In step 3, foaming metal 3 is covered with preformed metal sheet 4.

FIG. 3 is a model view of step 3.

As shown in FIG. 3, metal sheet 4 comprises 2 members which unite each Other so as to cover foaming metal 3. Then metal sheet 4 is integrated by means of calking and so on to cover foaming metal 3. In unitting metal sheet 4, it is favorable to leave a narrow space between foaming metal 3 and metal sheet 4.

As for the material of metal sheet 4, stainless steel, phosphoric bronze and so on can be favorably used. The thickness of metal sheet 4 is preferably about 0.2–0.3 mm.

Metal sheet 4 may comprise more than 2 members and may be integrated by means of adhesion, welding and so on. There is no particular limitation of the method for forming metal sheet 4 and any suitable methods can be adopted, for example cold press, hot press and so on.

In step 4, casting is performed with foaming metal 3 covered with metal sheet 4 produced in step 3 as a core.

Figure 4:
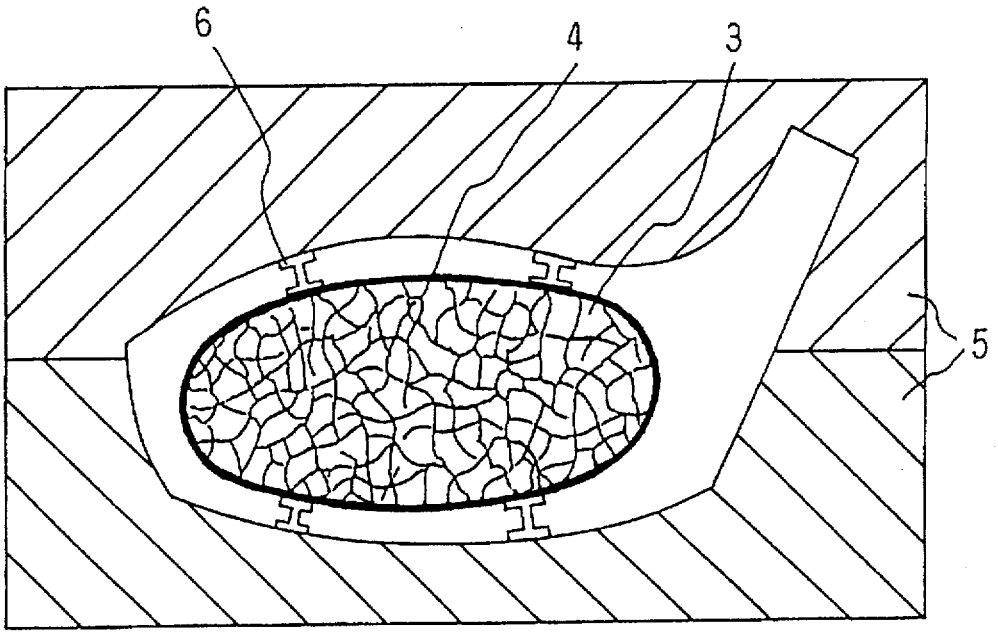
FIG. 4 is a model sectional view showing a step of producing a metal wood club head for golf relating to the present invention that foaming metal covered with metal sheet is put into a casting mold as a core.

FIG. 4 is a model sectional view showing a core of foaming metal 3 covered with metal sheet put into casting mold 5. (FIG. 4 shows portions necessary for description and omitts ingate, sprue runner and so on.)

Figure 5:
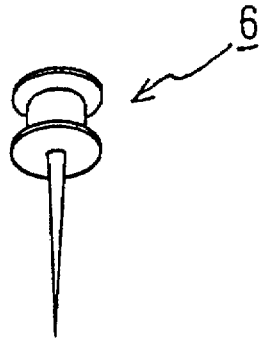
FIG. 5 shows another embodiment of a chaplet used in a step of producing a metal wood club head for golf relating to the present invention.
Figure 6:
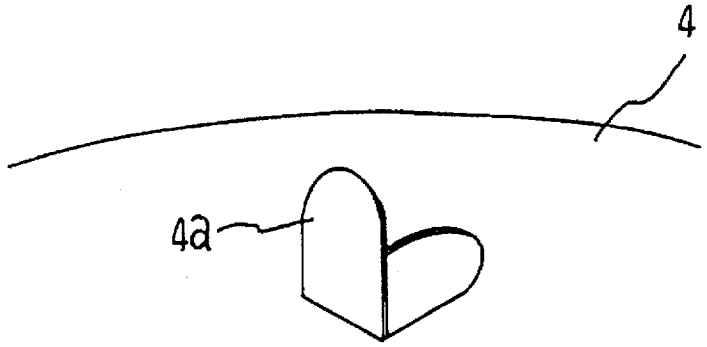
FIG. 6 is a partial view showing another means for positioning a core in a casting mold in a step of producing a metal wood club head for golf relating to the present invention.

In FIG. 4, chaplets 6 are provided between casting mold 5 and core (foaming metal) 3 as means for postioning core 3 in casting mold 5 spaced from the inner surface of mold 5 by a distance corresponding to the thickness of outer shell 2. FIG. 4 shows I-shaped chaplet 6, however there is no limitation of the shape of chaplet 6. Pin-shaped chaplet may be used as shown in FIG. 5 and any shapes generally used, such as U-shape and T-shape, may be adopted.

Figure 7:
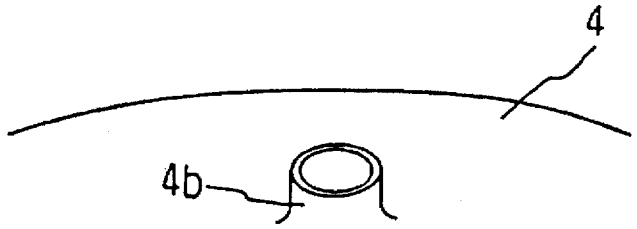
FIG. 7 is a partial view showing another means for positioning of a core in a casting mold in a step of producing a metal wood club head for golf relating to the present invention.

As for another method for positioning core 3 in casting mold 5 spaced from the inner surface of mold 5 by a distance corresponding to the thickness of outer shell 2, raised portion **4*a* is formed by making a cut on the surface of core 3 and raising the cut, and positions core 3 in casting mold 5. Core 3 may be positioned in mold 5 by means of projection 4*b* formed by burring as shown in FIG. 7. Raised portions 4*a* or projections 4*b* are provided at suitable positions and by suitable number for positioning core 3 in casting mold 5. Said chaplets 6** are also provided in the same manner.

Means for postioning core 3 spaced from the inner surface of mold 5 by a distance corresponding to the thickness of outer shell 2 is not limited to the above mentiond means and any suitable means can be adopted.

In step 5, metal wood club 1 comprising metal outer shell 2 with a hollow inside portion, foaming metal 3 arranged in the hollow inside portion and metal sheet lying between foaming metal 3 and metal outer shell 2 is produced by pouring molten metal into casting mold 5 in which a core of foaming metal 3 covered with metal sheet 4 is fixed as shown in the above step 4 and taking a molding out of casting mold 5 after cooling. There is no limitation of the kind of the molten metal, namely materials of metal outer shell 2, and any known materials to be generally used for metal wood club heads may be used. To put it concretely, stainless alloy, alminium alloy, titanium, titanium alloy and so on can be favorably used.

Titanium or titanium alloy is affixed on the face of metal wood club head 1 produced by steps 1 through 5.

By covering foaming metal 3 with metal sheet 4 as described above, foaming metal 3 does not directly contact with molten metal of high temperature so that foaming metal 3 is not melted by the heat of the molten metal.

Air layer of space left between foaming metal 3 and metal sheet 4 can fulfill its function as a heat insulating layer so that foaming metal 3 can be more effectively protected from heat. The air layer disappears resulting in superb adhesiveness since molten metal shrinks by cooling.

To adhere foaming metal 3 and metal sheet 4 more closely, a part of molten metal may be poured through apertures provided on metal sheet 4 and melts into foaming metal 3. The number and the size of the apertures are not limited and any suitable number and any suitable size of the apertures may be adopted, however, it is preferable to adopt the apertures of which diameter is about 3–5 mm.

When raised portions **4*a* or projections 4*b* are provided on metal sheet 4, a part of molten metal is poured through base apertures of raised portions 4*a* or apertures of projections 4*b* and melts into foaming metal 3 so that foaming metal 3 can adhered more closely to metal sheet 4. Moreover, raised portions 4*a* or projections 4*b* also have the effect of positioning core 3 in casting mold 5** without chaplets.

As for the above-mentioned casting, squeeze-casting is preferably adopted. By adopting squeeze-casting foams formed in pouring molten metal do not get mixed in forming so often, therefore blow holes in moldings can be prevented.

As described above, carbon material compounded with carbon fiberes can be substitude for foaming metal 3 in said steps. The substitution results in the advantage that it becomes possible to infolding the core in stainless steel, titanium and so on without covering the core with metal sheet by casting since heat resistant temperature of carbon material compounded with carbon fibers is 2,000° C. which is high enough.

I claim:

1. A method for producing a metal wood golf club head and a metal wood golf club with this club head, wherein the club head comprises a metal outer shell with a hollow inside portion and at least one element selected from a group of foaming material consisting of foaming metal and foaming carbon material compounded with carbon fibers and arranged in a hollow inside portion, comprising:

roughly cutting said at least one element by machine to leave a portion;

forming the portion into a core having an egg shape by a metal forming mold of an upper mold and a lower mold.

2. A method for producing a metal wood golf club head and a metal wood golf club with this club head as set forth in claim 1, further comprising:

arranging the core into a cavity confined by inner surfaces of a casting mold;

laying spacers between the core and the inner surfaces of the casing mold to leave a space corresponding to the thickness of the outer shell; and casting with a molten metal.

3. A method for producing a metal golf club head and a metal wood golf club with this club head as set forth in claim 2, further comprising covering the core with a metal sheet having at least one member.

4. A method for producing a metal wood golf club head and a metal wood golf club as set forth in claim 3, wherein said metal sheet has apertures through which a part of molten metal is poured to cast said core and said metal outer shell integrally.

5. A method for producing a metal wood golf club head and a metal wood golf club with this club head as set forth in claim 3, further comprising:

providing a raised portion having heights corresponding to the thickness of the metal of the metal outer shell by cutting base apertures on a metal sheet position and raising said metal sheet at the apertures position;

fixing said core in the casting mold with leaving a space corresponding to the thickness of the metal of the shell between the core and the casting mold; and casting integrally by pouring a part of the molten metal through the base apertures of the raised portions.

* * * * *